US009045295B2

(12) United States Patent
Bubbio et al.

(10) Patent No.: US 9,045,295 B2
(45) Date of Patent: Jun. 2, 2015

(54) MOTOR-DRIVEN ALIGNING AND FORWARDING DEVICE FOR APPARATUS FOR PROCESSING PAPER DOCUMENTS AND THE LIKE, IN PARTICULAR BANK CHEQUES

(71) Applicant: PANINI S.P.A., Turin (IT)

(72) Inventors: Pierpaolo Bubbio, Turin (IT); Manlio Lombardo, Strambino (IT)

(73) Assignee: PANINI S.P.A., Turin (IT)

( * ) Notice: Subject to any disclaimer, the term of this patent is extended or adjusted under 35 U.S.C. 154(b) by 0 days.

(21) Appl. No.: 14/376,069

(22) PCT Filed: Jan. 31, 2013

(86) PCT No.: PCT/IB2013/050819
§ 371 (c)(1),
(2) Date: Jul. 31, 2014

(87) PCT Pub. No.: WO2013/114310

PCT Pub. Date: Aug. 8, 2013

(65) Prior Publication Data

US 2014/0367910 A1 Dec. 18, 2014

(30) Foreign Application Priority Data

Feb. 1, 2012 (IT) ..... TO2012A0081

(51) Int. Cl.

| | |
|---|---|
| ***B65H 7/02*** | (2006.01) |
| ***B65H 9/00*** | (2006.01) |
| ***B65H 9/10*** | (2006.01) |
| ***B65H 9/16*** | (2006.01) |
| ***B65H 9/06*** | (2006.01) |

(52) U.S. Cl.

CPC ..... *B65H 9/002* (2013.01); *B65H 9/106* (2013.01); *B65H 9/166* (2013.01); *B65H 2403/512* (2013.01); *B65H 2404/1442* (2013.01); *B65H 2701/1912* (2013.01); *B65H 9/006* (2013.01); *B65H 9/06* (2013.01)

(58) Field of Classification Search

CPC ..... B65H 5/06; B65H 9/00; B65H 9/002; B65H 9/10; B65H 9/103; B65H 9/106; B65H 9/166; B65H 9/006; B65H 9/06

USPC ..... 271/228, 250, 251, 252

See application file for complete search history.

(56) References Cited

U.S. PATENT DOCUMENTS

| | | | | |
|---|---|---|---|---|
| 8,348,267 | B2 * | 1/2013 | Storey et al. | 271/254 |
| 8,567,775 | B2 * | 10/2013 | Banal et al. | 271/252 |
| 2006/0038340 | A1 | 2/2006 | Schinzel-Reiner et al. | |
| 2009/0295075 | A1 | 12/2009 | Inoue | |

FOREIGN PATENT DOCUMENTS

| | | | |
|---|---|---|---|
| DE | 102 36 028 | A1 | 2/2004 |
| EP | 1 637 487 | A2 | 3/2006 |

OTHER PUBLICATIONS

International Search Report for PCT/IB2013/050819 dated Jun. 6, 2013.

* cited by examiner

*Primary Examiner* — David H Bollinger

(74) *Attorney, Agent, or Firm* — Sughrue Mion, PLLC

(57) ABSTRACT

The device (1) comprises a support housing (2-4) having first and second openings (3*a*, 3*b*) intended to be positioned during use facing an area (A) for the introduction of one or more documents (BC) to be processed, first and second rotatable gripping members (5, 6) for respectively performing aligning and forwarding, mounted in the housing (2-4) and designed to extend through the first and second openings (3*a*, 3*b*), respectively, these gripping members (5, 6) being rotatable about respective axes (V-V, U-U) oriented in different directions, and driving and control devices (10-17) designed to cause rotation of the gripping members (5, 6) about the respective axes (V-V, U-U) and their displacement through said openings (3*a*, 3*b*) between a retracted position and an extracted position with respect to the housing (2-4). The driving and control devices comprise: two cam members (10, 11) mounted rotatably in the housing (2-4), being rotationally locked together and having respective control profiles (16, 17) with respective profile portions (16*a*, 16*b*; 17*a*, 17*b*)

Figure 1:
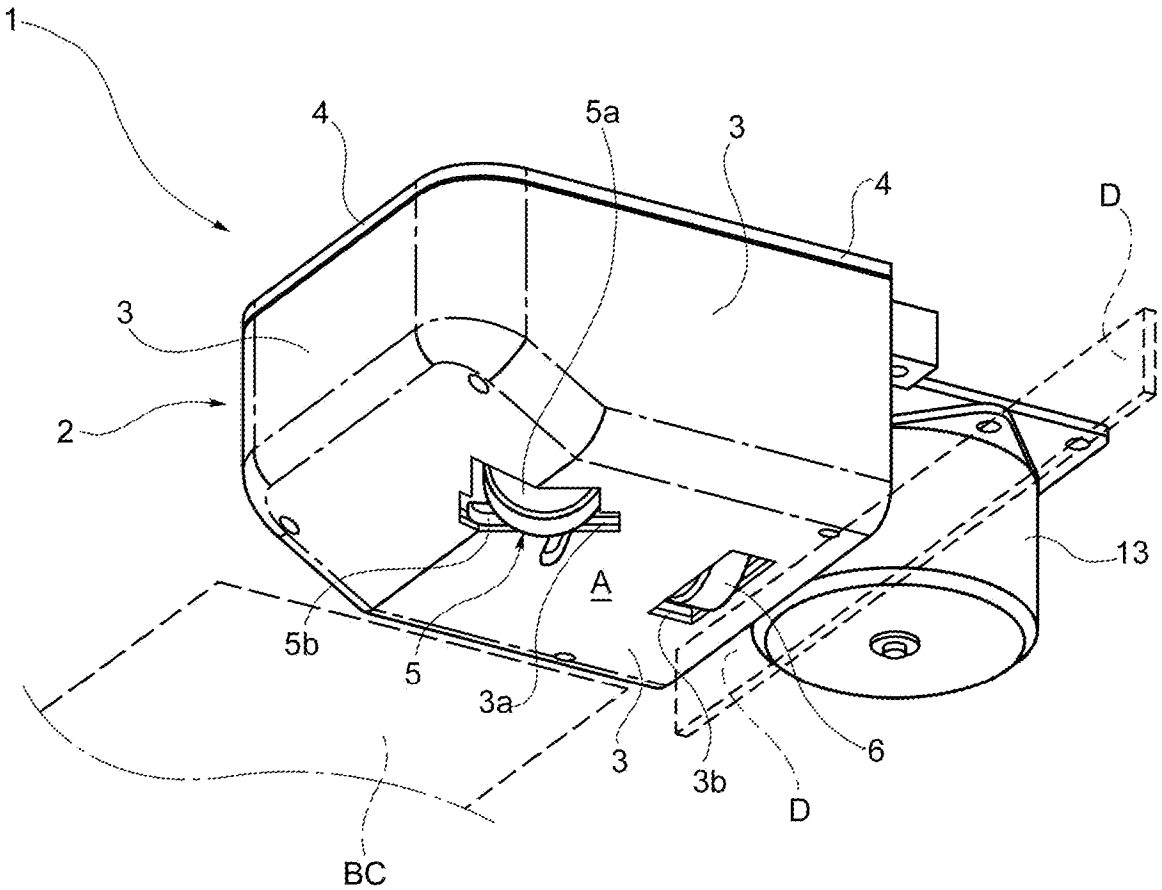

situated at different levels along a direction parallel to the axis of rotation (X-X) of the cam members (10, 11). These control profiles (16, 17) cooperate with the gripping members (5, 6) such that a rotation of the cam members (10, 11) is capable of causing corresponding rotations of the gripping members (5, 6) about the respective axes (V-V, U-U) as well as synchronized displacements of these gripping members (5, 6) in respective directions essentially parallel to the axis of rotation (X-X) of the cam members (10, 11), through the corresponding openings (3*a,* 3*b*) of the housing (2-4). A single rotary motor (13) is coupled with the cam members (10, 11) so as to cause the rotation thereof.

2 Claims, 2 Drawing Sheets

MOTOR-DRIVEN ALIGNING AND FORWARDING DEVICE FOR APPARATUS FOR PROCESSING PAPER DOCUMENTS AND THE LIKE, IN PARTICULAR BANK CHEQUES

The present invention relates to a motor-driven device for aligning and forwarding paper documents and the like, in particular bank cheques, for apparatus for processing such documents.

More specifically the invention relates to an aligning and forwarding device comprising:

- a support housing having first and second openings intended to be positioned during use facing an area for introduction of one or more documents to be processed;
- first and second rotatable gripping members for respectively performing aligning and forwarding, mounted in said housing and designed to extend into said introduction area through said first and second openings, respectively, of the housing, said gripping members being rotatable about respective axes oriented in different directions; and
- driving and control means designed to cause rotation of said gripping members about the respective axes and the displacement of said gripping members through the aforementioned openings between a respective retracted position and a respective extracted position with respect to the housing.

Aligning and forwarding devices of this type are known, said devices comprising movement and control means which are relatively complex and costly and often require the use of two separate electric motors for operating the aligning gripping member and the forwarding gripping member.

One object of the present invention is to provide an aligning and forwarding device of the type specified above, the movement and control means of which have a structure which is relatively simple, not costly and operationally very reliable.

This object, together with other objects, is achieved according to the present invention by an aligning and forwarding device of the type specified above, characterized in that the aforementioned driving and control means comprise:

- cam means mounted rotatably in said housing and having first and second control profiles rotationally locked together and having respective profile portions situated at different levels along a direction parallel to the axis of rotation of the cam means and cooperating with said first and second gripping members, respectively, such that a rotation of the cam means is capable of causing corresponding rotations of the gripping members about the respective axes as well as synchronized displacements of said gripping members in respective directions essentially parallel to the axis of rotation of the cam means, through the corresponding openings of the housing; and
- a single rotary motor coupled with the cam means so as to cause the rotation thereof.

Conveniently, the aforementioned cam means have two essentially annular control profiles coaxial with each other.

Figure 2:
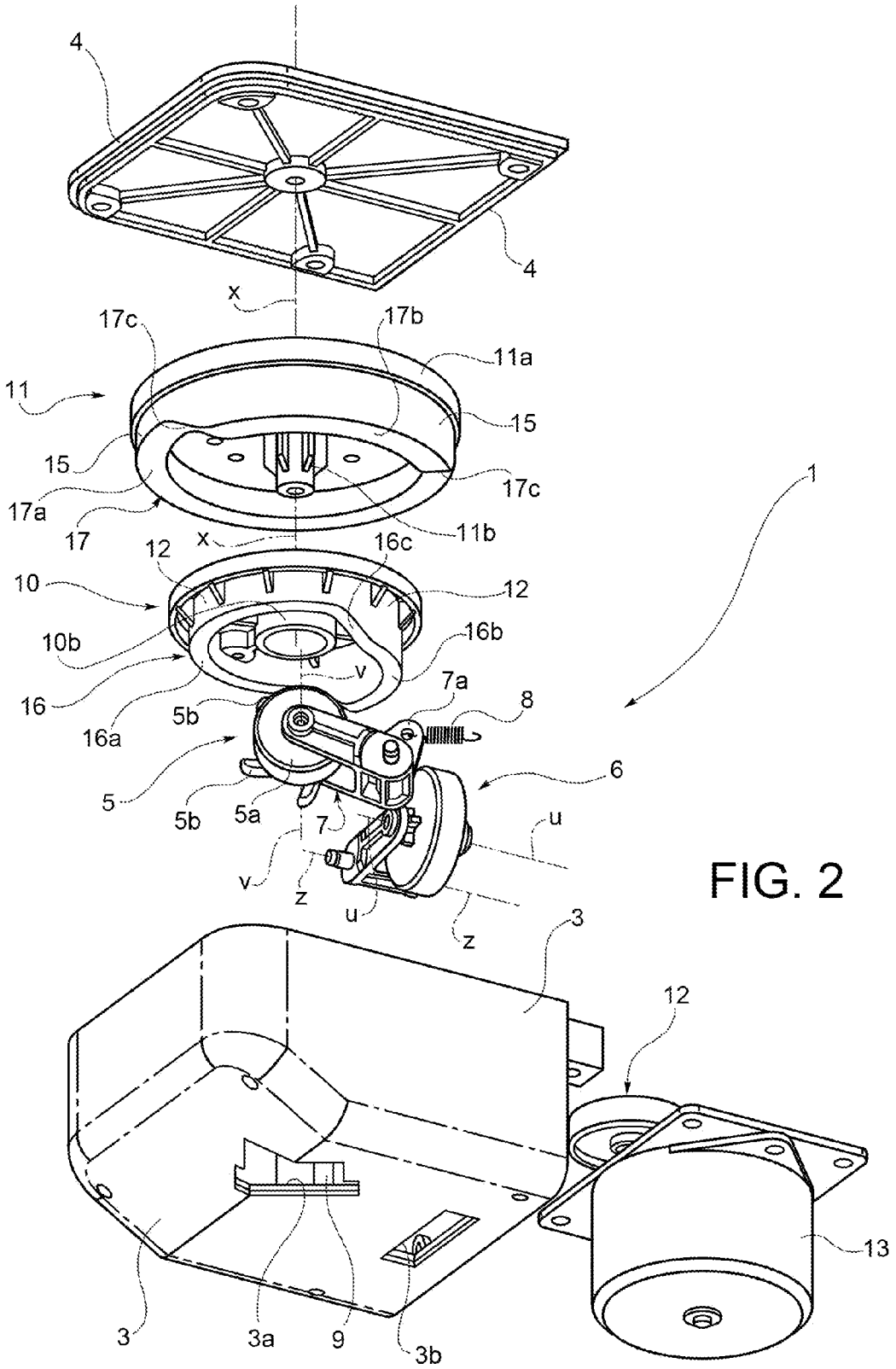

Further characteristic features and advantages of the invention will become clear from the following detailed description provided purely by way of a non-limiting example, with reference to the accompanying drawings in which:

FIG. 1 is a perspective view of a motor-driven device for aligning and forwarding documents according to the present invention; and FIG. 2 is a partially exploded perspective view of the device shown in FIG. 1.

In the drawings 1 denotes overall a motor-driven device for aligning and forwarding documents according to the present invention.

In the exemplary embodiment shown, the device 1 comprises a support housing denoted overall by 2, including an essentially tray-shaped body 3, and an associated removable closing cover 4.

A pair of openings denoted by 3*a* and 3*b*, respectively, are formed in the bottom side of the tray-shaped body 3.

These openings 3*a*, 3*b* are positioned, during use, facing an area A for the introduction of one or more documents to be processed, such as the bank cheque BC which is partially shown in broken lines in FIG. 1.

The area A for the introduction of the documents to be processed is bounded on one side by a lateral alignment wall D, which may form part of the aligning and forwarding device 1 or may be provided in the document processing apparatus (known per se) with which such an aligning and forwarding device is associated.

In FIG. 1 it is assumed that the documents BC to be processed are introduced in a direction F substantially parallel to the direction of the alignment wall D or forming a small angle with respect to the direction of this wall, for example an angle of less than 40°.

First and second gripping members, denoted by 5 and 6, are rotatably mounted in the support housing 2 of the aligning and forwarding device 1.

The gripping member 5 is intended to perform alignment of the documents BC, pushing them towards and against the wall D, and comprises for example a wheel 5*a* with a smooth periphery, provided on one side with a plurality of angularly spaced flexible petals 5*b*.

As can be seen in FIG. 2, the gripping member 5 is mounted rotatably about an axis V-V, between the two arms or prongs of a fork-shaped member 7. The latter is in turn mounted rotatably in the body 3 of the support housing, about an axis W-W, parallel to the axis V-V.

The fork-shaped member 7 has a lug 7*a* having, attached thereto, one end of a recall spring 8, the other end of which is attached (in a manner not shown) to a retaining element in the support housing 2.

The gripping member 6 is intended to perform forwarding of the documents BC introduced into the introduction area A and aligned against the wall D and is essentially a roller wheel with a smooth periphery, mounted rotatably about an axis U-U, between the two arms or prongs of a further fork-shaped member 9. The latter is in turn mounted rotatably in the tray-shaped body 3 of the support housing 2, about an axis Z-Z, parallel to the axis U-U.

A recall spring, not visible in the drawings, is also associated with the rotatable gripping member 6.

The tray-shaped body 3 of the support housing 2 has, extending therein, a pin 9 (FIG. 2) integral with the said body 3. Two cam members, denoted by 10 and 11 in FIG. 2, are mounted coaxially rotatably about the pin 9.

In the exemplary embodiment shown, the cam member 11 has a peripheral annular actuating surface 11*a* which is coupled with the peripheral surface of a drive wheel 12 capable of being rotationally operated by an electric motor 13 fixed to the support housing 2.

The cam member 11 has a central hub 11*b* coupled with a corresponding central hub 10*b* of the cam member 10 so that said cam members 10 and 11 are rotationally locked together.

During operation, activation of the electric motor 13 causes, by means of the wheel 12, a rotation of the cam member 11 which in turn correspondingly rotationally drives the cam member 10.

In FIG. 2 the common axis of rotation of the cam members 10 and 11 has been indicated by means of X-X.

The cam member 10 has a coaxial annular formation 16 which, on the side directed towards the rotatable gripping member 5, defines an essentially annular control profile, with two profile portions 16*a* and 16*b* situated at different levels along the direction of the axis X-X. These profile portions 16*a* and 16*b* are connected together by means of intermediate ramp or profile portions 16*c*, of which only one is visible in FIG. 2.

The periphery of the wheel 5*a* of the gripping member 5, owing to the action of the recall spring 8, is kept in constant engagement with the profile 16 of the cam member 10.

Similarly, the cam member 11 has a coaxial annular formation 15 which, on the side directed downwards in FIG. 2, has an essentially annular control profile 17 including two profile portions 17*a* and 17*b* situated at respective different levels along the axis X-X and connected together by intermediate profile or ramp portions 17*c*.

The peripheral surface of the rotating forwarding member 6 is kept in constant engagement with the profile 17 of the cam member 11.

The arrangement is such that activation of the electric motor 13 is capable of causing combined rotation of the cam members 10 and 11 which, with their respective control profiles 16 and 17, produce corresponding rotations of the associated gripping members 5 and 6 about the respective axes V-V and U-U as well as synchronized displacements of these gripping members 5, 6 in respective directions essentially parallel to the axis X-X, through the openings 3*a* and 3*b*, respectively, of the body or shell 3 of the support housing 2.

Operation of the motor 13 is therefore capable of causing not only rotation of the gripping members 5 and 6, but also displacement thereof through the openings 3*a* and 3*b* of the support housing, between a respective retracted position and a respective extracted position.

In fact, when the gripping members 5 and 6 act against the portions 16*a* and 17*a* of the associated control profiles 16 and 17 of the cam members, these gripping members are kept in the retracted condition by the associated recall springs.

When the gripping members 5 and 6 act against the portions 16*b* and 17*b* of the associated control profiles 16 and 17, they extend through and outside the openings 3*a* and 3*b* of the support housing, protruding into the zone A for introduction of the documents BC.

The relative synchronism of the displacements of the gripping members 5 and 6 through the respective openings 3*a* and 3*b* of the support housing depends on the relative angular position of the control profiles 16*b* and 17*b* of the associated cam members 10 and 11.

As persons skilled in the art will readily understand, the device according to the invention requires the use of a single rotary motor for performing both rotation and movement of the gripping members 5 and 6 through the respective openings or slits in the support housing.

Control of the movement of these gripping members 5 and 6 is performed by means of two cam members which are simple and inexpensive to produce and cooperate therewith in the manner of feelers.

Obviously, without affecting the principle of the invention, the embodiments and the constructional details may be significantly modified with respect to that described and illustrated purely by way of a non-limiting example, without thereby departing from the scope of the invention as defined in the accompanying claims.

The invention claimed is:

1. Motor-driven device (1) for aligning and forwarding paper documents (BC) and the like, in particular bank cheques (BC), comprising:

a support housing (2-4) having first and second openings (3*a*, 3*b*) intended to be positioned during use facing an area (A) for the introduction of one or more documents (BC) to be processed;

first and second rotatable gripping members (5, 6) for respectively performing aligning and forwarding, mounted in said housing (2-4) and designed to extend through said first and second openings (3*a*, 3*b*), respectively, of said housing (2-4), said gripping members (5, 6) being rotatable about respective axes (V-V, U-U) oriented in different directions; and driving and control means (10-17) designed to cause rotation of said gripping members (5, 6) about the respective axes (V-V, U-U) and the displacement of said gripping members (5, 6) through said openings (3*a*, 3*b*) between a retracted position and an extracted position with respect to the housing (2-4);

the device (1) being characterized in that said driving and control means comprise:

cam means (10, 11) mounted rotatably in said housing (2-4) and having first and second control profiles (16, 17) rotationally locked together and having respective profile portions (16*a*, 16*b*; 17*a*, 17*b*) situated at different levels along a direction parallel to the axis of rotation (X-X) of the cam means (10, 11) and cooperating with said first and second gripping members (5, 6), respectively, such that a rotation of the cam means (10, 11) is capable of causing corresponding rotations of the gripping members (5, 6) about the respective axes (V-V, U-U) as well as synchronized displacements of said gripping members (5, 6) in respective directions essentially parallel to the axis of rotation (X-X) of the cam means (10, 11), through the corresponding openings (3*a*, 3*b*) of the housing (2-4); and a single rotary motor (13) coupled with the cam means (10, 11) so as to cause the rotation thereof.

2. Device according to claim 1, wherein the aforementioned cam means (10, 11) have two essentially annular control profiles (16, 17) coaxial with each other.

* * * * *